United States Patent [19]

Otsubo

[11] Patent Number: 4,929,805

[45] Date of Patent: May 29, 1990

[54] GAS DAMPED DECELERATION SWITCH

[75] Inventor: Kazumi Otsubo, Saitama, Japan

[73] Assignee: Honda Giken Kogyo Kabushiki Kaisha, Tokyo, Japan

[21] Appl. No.: 239,894

[22] Filed: Sep. 2, 1988

[30] Foreign Application Priority Data

Sep. 4, 1987 [JP] Japan ..... 62-135273[U]

[51] Int. Cl.[5] ..... H01H 35/14

[52] U.S. Cl. ..... 200/61.45 R; 200/61.53

[58] Field of Search ..... 200/61.45 R, 61.45 M, 200/61.47, 61.53; 180/282; 340/52 H, 669, 670; 73/514, 517 R; 280/735; 307/10 R

[56] References Cited

U.S. PATENT DOCUMENTS

| | | | |
|---|---|---|---|
| 4,097,699 | 6/1978 | Larson | 200/61.53 X |
| 4,536,629 | 8/1985 | Diller | 200/61.53 X |
| 4,641,041 | 2/1987 | Mattes et al. | 307/10 R |

*Primary Examiner*—J. R. Scott

*Attorney, Agent, or Firm*—Armstrong, Nikaido, Marmelstein, Kubovcik & Murray

[57] ABSTRACT

A deceleration switch for detecting deceleration in excess of a certain magnitude which, for instance, may be indicative of a vehicle crash, comprising: a pair of electrodes having internal and external ends; a contact set electrically connected to the internal ends; a mass supported by a spring or the like and adapted to move from a neutral position to an active position for actuating the contact set under its inertia force when deceleration of a certain magnitude is applied to the switch; and a circuit for checking the electric conductance between the internal end and the external end of at least one of the electrodes. The circuit may consist of either lead wires connected to the internal and external ends of the electrodes or a resistor connected across the internal ends of the electrodes. In the latter case, by conducting electric current through the resistor from the external ends of the electrodes and monitoring the flow of the electric current, it is possible to detect any break in the electric path of the deceleration switch. Thus, since the condition of the electrodes, which typically consist of elastic materials and are subjected to vehicle vibrations, can be always monitored, the reliability of the deceleration switch is much improved.

8 Claims, 2 Drawing Sheets

GAS DAMPED DECELERATION SWITCH

TECHNICAL FIELD

The present invention relates to a deceleration switch which can be used for actuating a passive occupant restraint system for a vehicle, and in particular to such a deceleration switch with improved reliability.

BACKGROUND OF THE INVENTION

Various passive occupant restraint systems have been proposed to protect vehicle occupants, in case of a vehicle crash, from secondary impacts resulting from the collision of the occupants with the interior surfaces of the passenger compartment. Such passive occupant restraint systems include various forms of inflatable air bags and seat belt retractor systems which are capable of removing a slack in the seat belt. These passive occupant restraint systems require a sensor for detecting the occurrence of a crash.

Generally, acceleration sensors or deceleration sensors are used for such a purpose, and these sensors are mounted in the parts of the vehicles which are suitable for detecting an acceleration level indicative of a crash substantially without any time delay or which are relatively free from undesirable accidental activation. Accordingly, they may be arranged in the front parts of the vehicles, on the floor tunnels adjacent to the vehicle occupants and other appropriate locations. Therefore, they are often placed in poorly accessible locations. Further, considering the function of such sensors, it is difficult to routinely test the capability of the sensors to operate satisfactorily.

U.S. Pat. No. 4,536,629 discloses a gas damped acceleration switch in which a mass is supported by a spiral spring in such a manner that a contact set is closed only after the mass has traveled a certain distance against the spring by an inertia force acting on it. Further, damping means is provided to the mass so that the acceleration switch be insensitive to shocks of short durations and small magnitudes, and be prevented from actuating the passive occupant restraint system in conditions other than crash situations.

In such an acceleration switch, it is extremely important to assure the electric circuitry to be in working order at all times. For instance, if there is any break in the circuitry connected in series with the contact set which is designed to be closed when the acceleration switch is subjected to an acceleration indicative of a crash, the acceleration switch is totally incapable of detecting any such acceleration. This is significant all the more because it cannot be discovered unless a through testing of the circuitry is performed.

BRIEF SUMMARY OF THE INVENTION

In view of such problems of the prior art, a primary object of the present invention is to provide a deceleration switch which is made reliable through provision of means for detecting the presence of any break in its circuitry which is required to be continuous for its satisfactory performance.

A second object of the present invention is to provide a deceleration switch which is provided with means for detecting any break in its circuit as soon as such a break is produced.

These and other objects of the present invention can be accomplished by providing a deceleration switch for detecting acceleration of a certain magnitude, comprising: a pair of electrodes having internal ends and external ends; contact means electrically connected to the internal ends of the electrodes; a mass supported by spring means and adapted to move from a neutral position to an active position for actuating the contact means under its inertia force when acceleration of a certain magnitude is applied to the switch; and means for checking the electric conductance between the internal end and the external end of at least one of the electrodes. Thus, the condition of the electrodes can be watched all the time. This is particularly significant because the electrodes typically consist of elastic materials, such as spring leaves, and are subjected to vehicle vibrations, and because such sensors are often placed in a poorly accessible part of a vehicle and are therefore unsuitable for regular inspection.

According to a preferred embodiment of the present invention, the contact means consists of a normally open contact set which closes when actuated by the mass, and the electric conductance checking means comprises a resistor which is connected across the internal ends of the electrodes, and electric current monitoring means which is connected to the external ends of the electrodes and monitors electric current which is conducted through the resistor. Thus, no extra terminals are required to be provided in the acceleration switch to monitor the condition of the electrodes.

BRIEF DESCRIPTION OF THE DRAWINGS

Now the present invention is described in the following in terms of specific embodiments with reference to the appended drawings, in which.

DETAILED DESCRIPTION OF THE PREFERRED EMBODIMENTS

Figure 1:
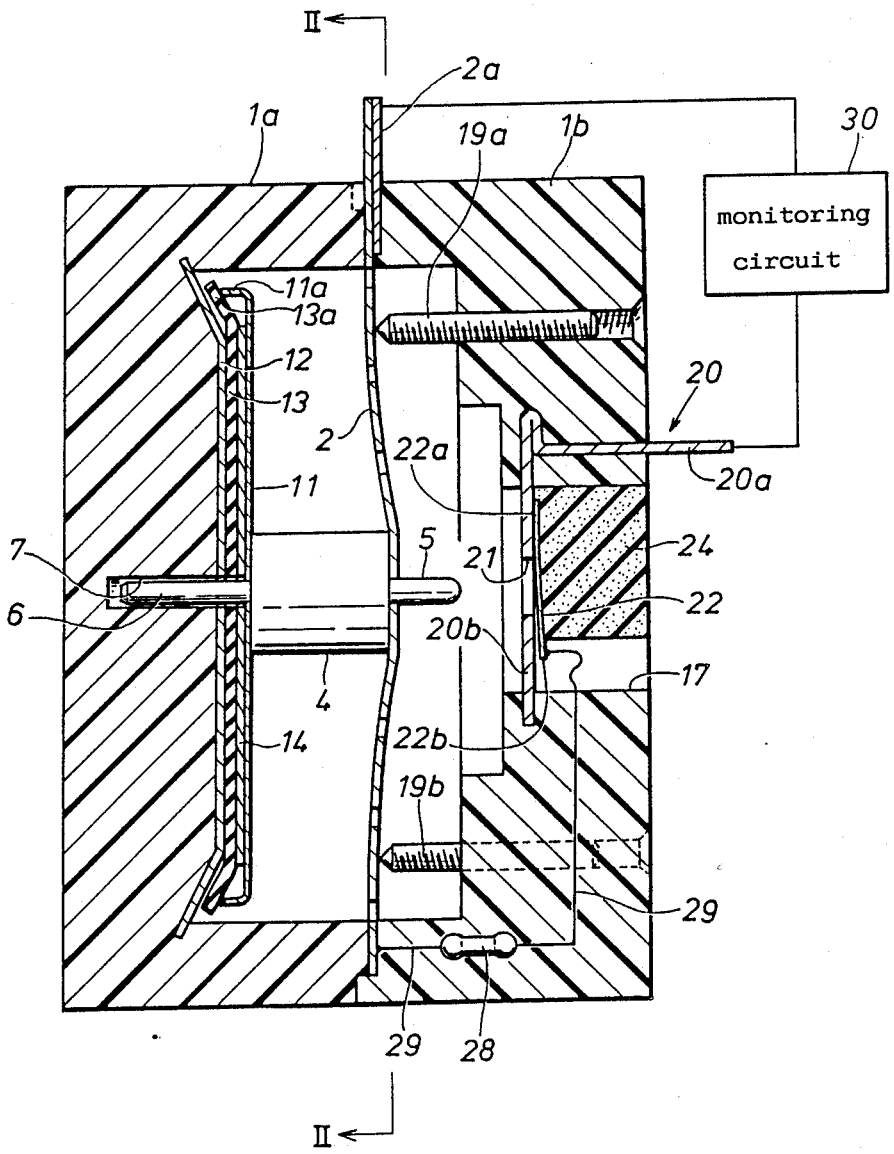
FIG. 1 is a sectional view of an embodiment of the deceleration switch according to the present invention.
Figure 2:
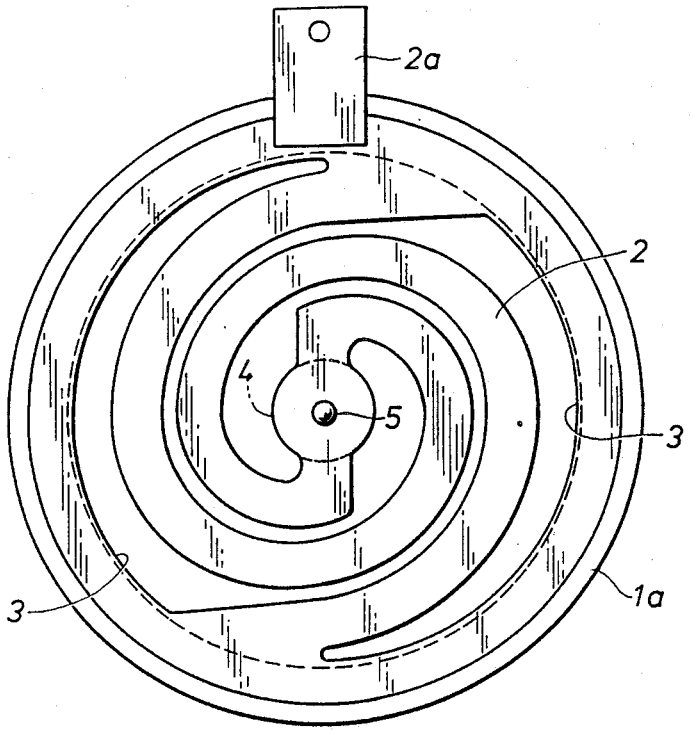
FIG. 2 is a sectional view taken along line II—II of FIG. 1.

FIGS. 1 and 2 show the first embodiment of the deceleration switch according to the present invention. The casing 1 of this deceleration switch consists of a rear half 1*a* and a front half 1*b*, each consisting of a generally cylindrical cup-shaped member which is injection molded from a plastic material These two halves 1*a* and 1*b* are integrally joined together at their rims with a spiral sheet spring 2 interposed therebetween.

As best shown in FIG. 2, the spiral sheet spring 2 is made from a circular sheet of phosphor bronze by cutting out a pair of spiral notches 3 extending from the center towards the periphery. A cylindrical sensor mass 4 is attached to the center of the rear surface of the spiral sheet spring 2 by brazing. The front end of the sensor mass 4 is provided with a pin 5 which is passed through the center of the spiral sheet spring 2. The rear end of the sensor mass 4 is attached to a disk 11 made of circular sheet metal by blazing, and is provided with a rod 6 which is passed through the disk 11 and received in a guide hole 7 provided in the bottom wall of the rear half 1*a* of the casing 1. The outer periphery of the disk 11 is provided with an axial flange 11*a* directed towards the bottom surface of the rear half 1*a* of the casing 1.

The bottom surface of the rear half 1*a* is slightly depressed along its outer periphery and is generally covered by a back up plate 12 which is integrally insert molded with the rear half 1a of the casing 1. A relatively rigid retainer plate 14 is attached to the back up plate 12 at their centers, for instance by spot welding, with a flexible suction sheet 13 interposed therebetween. This suction sheet 13 is made of a soft material, such as synthetic rubber, and its outer periphery 13a protrudes from the outer periphery of the retainer plate 14. As best shown in FIG. 1, the diameter of the axial flange 11a of the disk 11 is larger than the outer diameter of the retainer plate 14 but is smaller than the outer diameter of the suction sheet 13.

Thus, the sensor mass 4 is allowed to undergo an axial motion only, by means of the rod 6 and the guide hole 7, and is elastically supported by the spiral sheet spring 2. Further, the motion of the sensor mass 4 is damped by the vacuum suction created between the disk 11 and the suction sheet 13, as well as by the fluid resistance resulting from the motion of the disk 11 inside the cylindrical chamber defined in the casing 1.

A part of the outer periphery of the spiral sheet spring 2 is provided with a terminal piece 2a which protrudes outwardly from the casing 1. A pair of set screws 19a and 19b are threaded axially through the bottom wall of the front half 1b of the casing 1 at symmetric positions and the free ends of these set screws 19a and 19b abut parts of the spiral sheet spring 2. Thus, by adjusting these set screws 19a and 19b, the preloading of the spiral sheet spring 2 can be adjusted.

The central part of the bottom wall of the front half 1b of the casing 1 is provided with a bore 17. An L-shaped terminal piece 20 is insert molded in the bottom wall of the front half 1b, and its one end 20a protrudes axially and outwardly from the bottom wall while its other end 20b extends across the bore 17. A middle part of the other end 20b is provided with a hole 21 for inserting the pin 5 therethrough, and a spring leaf 22 is attached to the rear surface of the terminal piece 20 at its one end 22a for elastically contacting the free end of the pin 5 when it has passed through the hole 21 under its inertia force in the case of a crash.

The bore 17 is generally filled with soft foam rubber 24 to give some damping to the motion of the spring leaf 22 when the pin 5 of the sensor mass 4 runs into the spring leaf 22.

A resistor 28 is encapsulated in the bottom wall of the front half 1b of the casing 1, and is connected to the part of the spiral sheet spring 2 which is diametrically opposed to the terminal piece 2a at its one end and to the free end 22b of the spring leaf 22 at its other end. Thus, a continuous electric path is formed from the outer end 20a of the terminal piece 20, the spring leaf 22, the resistor 28, the sheet spring 2 and the terminal piece 2a. Thus, according to this embodiment, by conducting electric current of a small amplitude through this continuous electric path and monitoring the flow of the electric current with a monitoring circuit 30, it is possible to detect any break in this otherwise continuous path. Alternatively, the other end of the resistor 28 may be connected to a central part of the spiral sheet spring 2 or other parts of the spiral sheet spring 2.

While the invention has been particularly shown and described in reference to preferred embodiments thereof, it will be understood by those skilled in the art that changes in form and details may be made without departing from the spirit and scope of the invention.

It is also possible to eliminate the resistor 28 and provide two more terminal pieces which are connected to the free end 22b of the spring leaf 22 and a part of the spiral sheet spring 2, respectively, for directly monitoring the continuity of the electric paths between the external end 20a of the terminal piece 20 and the free end 22b of the spring leaf 22, and between the terminal piece 2a and a part of the spiral sheet spring 2, respectively.

Now the action of this embodiment is described in the following:

Normally, the sensor mass 4 is elastically supported by the spiral sheet spring 2, and the disk 11 is in close contact with the retainer plate 14 with the axial flange 11a of the disk 11 touching the periphery 13a of the suction sheet 13.

When a deceleration is applied to the sensor mass 4, the sensor mass 4 is urged toward the front half 1b of the casing 1 under its own inertia force. Thus, the sensor mass 4 is thrust forward, but encounters two opposing forces; one of the opposing forces is the elastic force from the spiral sheet spring 2 which may be preloaded as desired while the other opposing force arises from the vacuum which is generated in the space defined by the disk 11, the outer periphery 13a of the suction sheet 13 and the retainer plate 14. Thus, the sensor mass 4 can move forward until the pin 5 comes into contact with the spring leaf 22 only when the inertia force of the sensor mass 4 can overcome these two opposing forces, or when the deceleration level is indicative of an actual vehicle crash. When the pin 5 is brought into contact with the spring leaf 22, a highly conductive electric path is formed between the terminal pieces 20 and 2a, and an appropriate passive occupant restraint system is thereby actuated.

Figure 3:
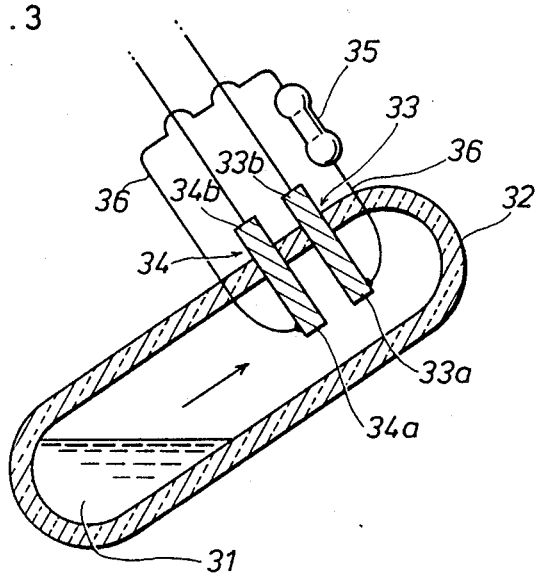
FIG. 3 is a sectional view showing another embodiment of the present invention.

FIG. 3 shows another embodiment of the present invention. In this embodiment, an appropriate amount of mercury 31 is sealed into an elongated container 32 made of an electrically insulating material such as glass, and a pair of electrodes 33 and 34 are inserted into the interior of the container 32 to the positions located above the surface level of the mercury 31. The outer ends 33b and 34b serve as the terminals for this deceleration switch. Further, a resistor 35 is connected across the inner ends 33a and 34a of the electrodes 33 and 34. Since the container 32 is slanted, when deceleration beyond a certain threshold level is applied to this deceleration switch, the surface level of the mercury 31 rises along the inner wall of the container 32 and touches the inner ends 33a and 34a of the electrodes 33 and 34. Thus, this deceleration switch can be used as a crash sensor for actuating a passive vehicle occupant restraint system by electrically connecting the two terminals 33b and 34b.

In this embodiment also, by conducting electric current of a small amplitude through the resistor 35 and monitoring the flow of the electric current with a monitoring circuit, it is possible to check the conductive path between the outer ends 33b and 34b of the electrodes 33 and 34, for instance, for any fatigue break in the electrodes which are subjected to vibrations, any failure in the soldered parts of the terminal pieces and so on.

Alternatively, it is possible to eliminate the resistor 35 and check the conductivity between the external terminal 33b or 34b and the inner most end 33a or 34a of each of the electrodes 33 or 34.

What we claim is:

1. A deceleration switch for detecting deceleration of a certain magnitude, comprising:

a casing;

a pair of electrodes having internal ends and external ends;

contact means including a retainer member and a spring leaf connector electrically connected to said internal ends of said electrodes;

a mass supported by said retainer member to move from a rest position to an active position for actuating said contact means under its inertial force when deceleration of a certain magnitude is applied to said mass; and means for checking an electric conductance pathway including at least one of said retainer member and said spring leaf connector of said contact means and at least one of said pair of electrodes.

2. A deceleration switch as defined in claim 1, wherein said contact means has a normally open contact portion which closes when actuated by said mass, and said electric conductance checking means comprises a resistor which is connected across said contact portion, and electric current monitoring means which is connected to said external ends of said electrodes to thereby monitor electric current conducted through said resistor.

3. A deceleration switch as defined in claim 2, wherein said electric conductance pathway includes at least an internal end portion of at least one of said electrodes extending into a cavity defined in said casing.

4. A deceleration switch as defined in claim 2, wherein said contact means comprises a first contact member carried by said mass, a spring member electrically connected between the internal end of one of said electrodes and said mass, and forming a part of said retainer member by supporting said mass, a second contact member supported by said casing and electrically connected to the internal end of the other electrode, and said electrode conductance pathway includes said spring member.

5. A deceleration switch as defined in claim 2, wherein said contact means comprises a first contact member carried by said mass and electrically connected to the internal end of one of said electrodes, and a second contact member supported by said casing and electrically connected to the internal end of the other electrode, and said electric conductance pathway includes at least one of said contact members.

6. A deceleration switch as defined in claim 1, wherein said retainer member includes a damper.

7. A deceleration switch as defined in claim 2, wherein said monitoring means includes a resistor electrically interconnecting said retainer member and said contact means, and a monitoring circuit means for electrically interconnecting said external ends of said pair of electrodes.

8. A deceleration switch as defined in claim 4, wherein said spring member is a spiral electrically conductive spring.

* * * * *